US012757952B2

(12) United States Patent
Kato et al.

(10) Patent No.: US 12,757,952 B2
(45) Date of Patent: Oct. 13, 2026

(54) GOLF GLOVE

(71) Applicant: LEVELCO Co., Ltd., Aichi (JP)

(72) Inventors: Koichi Kato, Aichi (JP); Miori Matsuura, Aichi (JP)

(73) Assignee: LEVELCO CO., LTD, Aichi (JP)

( * ) Notice: Subject to any disclaimer, the term of this patent is extended or adjusted under 35 U.S.C. 154(b) by 0 days.

(21) Appl. No.: 19/325,846

(22) Filed: Sep. 11, 2025

(65) Prior Publication Data

US 2026/0123698 A1 May 7, 2026

(30) Foreign Application Priority Data

Nov. 7, 2024 (JP) ..... 2024-195274
Apr. 14, 2025 (JP) ..... 2025-066423

(51) Int. Cl.
*A41D 19/015* (2006.01)
*A63B 71/14* (2006.01)

(52) U.S. Cl.
CPC . *A41D 19/01558* (2013.01); *A41D 19/01552* (2013.01); *A63B 71/146* (2013.01); *A63B 2209/10* (2013.01)

(58) Field of Classification Search
CPC ..... A41D 19/01558; A41D 19/101552; A63B 71/146; A63B 2209/10
USPC ..... 2/161.3
See application file for complete search history.

(56) References Cited

U.S. PATENT DOCUMENTS 9,027,873 B2 * 5/2015 Heverly, II ..... G10K 11/17854 700/280
9,962,594 B2 * 5/2018 Ramirez ..... A41D 19/01564
10,864,428 B2 * 12/2020 Ramirez ..... A41D 19/01547
2001/0025225 A1 * 9/2001 Ota ..... G06F 21/00 702/84
2004/0081801 A1 * 4/2004 Albert ..... A63B 71/148 428/343
2009/0183295 A1 7/2009 Birch et al.
2016/0367882 A1 * 12/2016 Ramirez ..... A63B 71/141
(Continued)

FOREIGN PATENT DOCUMENTS

JP 07-042451 Y 10/1995
JP 2013-034566 A 2/2013
(Continued)

OTHER PUBLICATIONS

Japanese Office Action for Application No. 2025-066426.

*Primary Examiner* — Gloria M Hale
(74) *Attorney, Agent, or Firm* — Lippes Mathias LLP

(57) ABSTRACT

Proposed is a golf glove, which is a technology to provide a sense of improved grip and to inhibit slipping of the grip during a swing. The glove has a base portion, a first finger portion, a second finger portion, and a third finger portion. The base portion has a dorsal portion and a palm portion. The first, second, and third finger portions are tubular portions extending from the base portion. The first finger portion is configured to allow the user's thumb to be inserted therein. The second finger portion is configured to allow the user's index finger to be inserted therein. The third finger portion is configured to allow the user's middle, ring, and little fingers of the user to be inserted together therein. The length of the third finger portion is a length that exposes at least the fingertips of the middle, ring, and little fingers.

6 Claims, 10 Drawing Sheets

(56) References Cited

U.S. PATENT DOCUMENTS

| | | | | |
|---|---|---|---|---|
| 2017/0312616 | A1* | 11/2017 | Ramirez | A41D 19/01564 |
| 2019/0168100 | A1* | 6/2019 | Ramirez | A41D 31/12 |

FOREIGN PATENT DOCUMENTS

| | | | |
|---|---|---|---|
| JP | 2014-230672 | A | 12/2014 |
| JP | 2015-101799 | A | 6/2015 |

* cited by examiner

GOLF GLOVE

CROSS REFERENCE TO RELATED APPLICATION

The present application claims priority to Japanese Patent Application No. 2024-195274, filed Nov. 7, 2024, and Japanese patent Application No. 2025-066423, filed Apr. 14, 2025, each of which is incorporated herein for all purposes by this reference.

BACKGROUND

Technical Field

The present disclosure relates to a golf glove that is worn on a user's hand.

Description of the Related Art

For example, Patent Document 1 discloses a golf glove that is worn on a user's hand. The glove described in Patent Document 1 includes a five-finger glove that covers each of the five fingers from the thumb to the little finger.

DOCUMENT OF RELATED ART (Patent Document 1) Japanese Patent No. 2014-230672A

SUMMARY

A user wears a glove like that described in Patent Document 1 for gripping a golf club and swinging. In this case, friction between the glove and the golf grip prevents the user's grip from slipping during the swing. This slip-resistance contributes to, for example, improved swing stability and increased club head speed.

However, when the user wears the glove, the glove is interposed between the hand and the grip when gripping. This makes it harder for the user to develop a keen sense of grip compared to holding the grip with a bare hand. A relatively dull grip makes it challenging to finely adjust grip strength or club head direction.

One aspect of the present disclosure provides a technology for preventing slipping of the grip during a swing while enhancing the grip sensation of a golf glove.

In order to achieve the above objective, according to an aspect of the present disclosure, there is provided a golf glove that is worn on a hand of a user, the glove including a base portion, a first finger portion, a second finger portion, and a third finger portion. The base portion includes a dorsal portion and a palm portion. The dorsal portion is configured to cover the back of the user's hand. The palm portion is configured to cover the palm of the user. The first, second, and third finger portions are tubular portions extending from the base portion. The first finger portion is configured to allow the user's thumb to be inserted therein. The second finger portion is configured to allow the user's index finger to be inserted therein. The third finger portion is configured to allow the user's middle, ring, and little fingers of the user to be inserted together therein. The length of the third finger portion is a length that exposes at least the fingertips of the middle, ring, and little fingers.

Due to the above configuration, it is possible to provide a sense of improved grip and to inhibit slipping of the grip during a swing.

In an aspect of the present disclosure, the length of the third finger portion may be a length that at least partially exposes second joints of the middle, ring, and little fingers. Due to this configuration, it may be easier to sharpen the sense of grip.

In an aspect of the present disclosure, the third finger portion may include: an outer portion located on the dorsal portion in a circumferential direction of the third finger portion; and an inner portion located on the palm portion in the circumferential direction of the third finger portion. The elongation rate of the inner portion may be smaller than that of the outer portion. Due to this configuration, it is possible to inhibit slipping of the grip during a swing.

In an aspect of the present disclosure, the third finger portion may include: an outer portion located on the dorsal portion in a circumferential direction of the third finger portion; and an inner portion located on the palm portion in the circumferential direction of the third finger portion. Of the outer and inner portions, at least the outer portion may have a stitch made of stretch yarn across an edge opposite to the base portion. Due to this configuration, it is possible to inhibit slipping of the grip during a swing.

In an aspect of the present disclosure, the stitch may be at least one of a cover stitch, a zigzag stitch, and a knit stitch. Due to this configuration, it is possible to inhibit slipping of the grip during a swing.

In an aspect of the present disclosure, the dorsal portion may include an anti-slip portion protruding from a surface that contacts the back of the user's hand. The anti-slip portion may contain a silicone resin. Due to this configuration, it is possible to inhibit slipping of the grip during a swing.

In an aspect of the present disclosure, the anti-slip portion is formed in a mesh shape. Due to this configuration, it is possible to inhibit slipping of the grip during a swing.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Hereinafter, exemplary embodiments of the present disclosure will be described with reference to the drawings.

1. First Embodiment

1-1. Configuration

Figure 1:
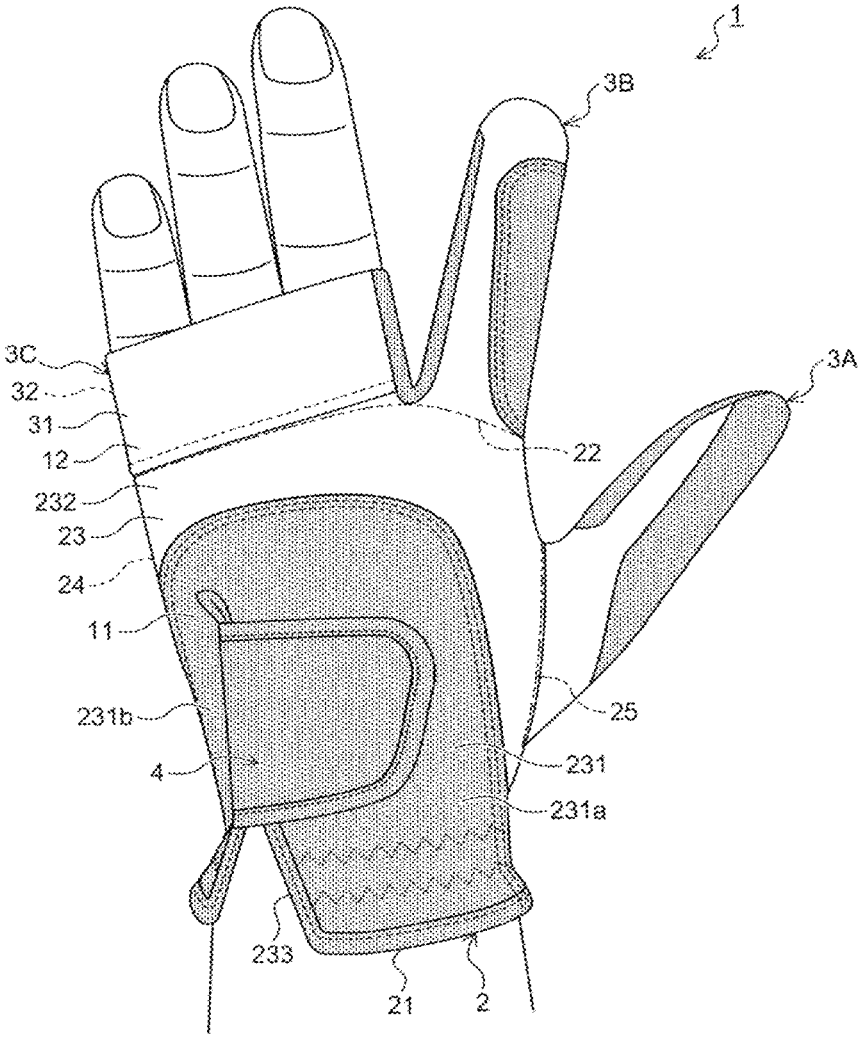
FIG. 1 is a front view of a glove with a belt portion closed according to a first embodiment.
Figure 5A:
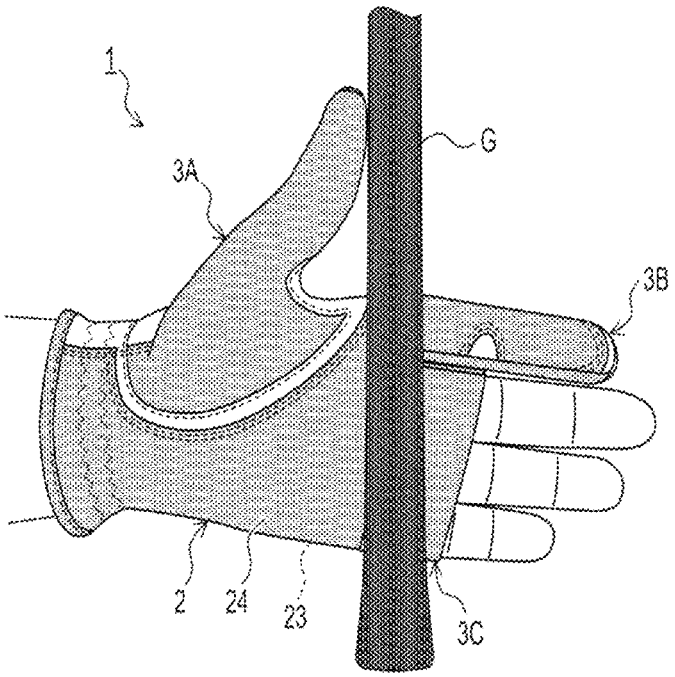
FIG. 5A is a schematic view showing a state in which a user wearing a glove according to a first embodiment places his or her hand on the grip of a golf club.
Figure 5B:
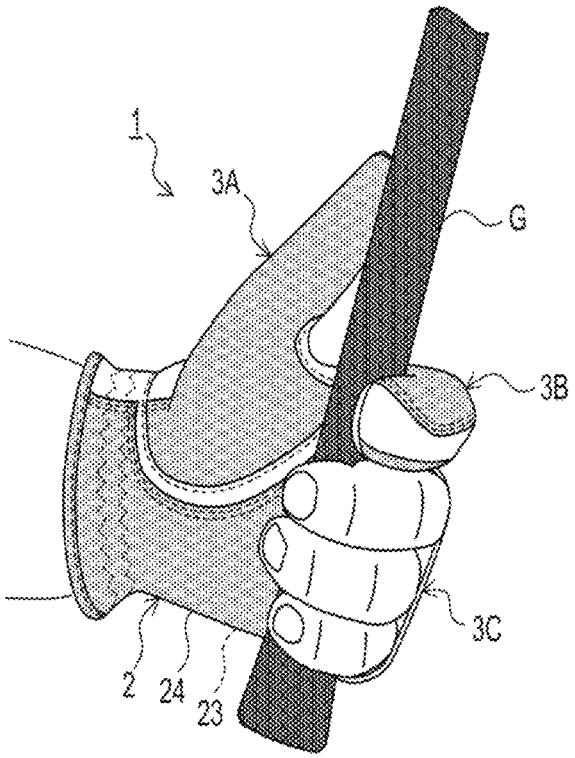
FIG. 5B is a schematic view showing a state in which a user wearing a glove according to a first embodiment is holding the grip of a golf club.

A glove 1 shown in FIG. 1 is worn on a user's hand. The glove 1 is for golf. The fact that the glove 1 is for golf means that the glove 1 is worn on the user's hand when playing golf. That is, as shown in FIGS. 5A and 5B, a user holds a grip G of a golf club while wearing the glove 1 on his or her hand.

As shown in FIG. 1, the glove 1 is formed by, for example, cutting and sewing a plurality of fabrics including at least a first fabric 11 and a second fabric 12. In the drawing, the first fabric 11 among the first fabric 11 and the second fabric 12 is provided with a hatching texture. Specific examples of the first fabric 11 and the second fabric 12 include leather such as natural leather, artificial leather, and synthetic leather, and fabric such as knitted fabric, woven fabric, and non-woven fabric. The types of the first fabric 11 and the second fabric 12 may be the same or different.

It is preferable that the elongation of the first fabric 11 is smaller than that of the second fabric 12. For example, it is preferable that the elongation with a larger numerical value among the longitudinal elongation and the transverse elongation of the first fabric 11 is smaller than the elongation with a larger numerical value among the longitudinal elongation and the transverse elongation of the second fabric 12. The elongation of the first fabric 11 and the second fabric 12 is the elongation under constant load [%] measured in accordance with a method described in JIS L 1096:2020 8.14. To be specific, in case that the first fabric 11 or the second fabric 12 is cloth, the elongation of the first fabric 11 and the second fabric 12 is the elongation under constant load [%] measured in accordance with method B described in JIS L 1096:2020 8.14. In case that the first fabric 11 or the second fabric 12 is leather, the elongation of the first fabric 11 or the second fabric 12 is the elongation under constant load [%] measured in accordance with method C described in JIS L 1096:2020 8.14.

In the present embodiment, the first fabric 11 is artificial leather, and the second fabric 12 is knitted fabric. The longitudinal elongation of the first fabric 11 is, for example, 70% or more and 130% or less. The transverse elongation of the first fabric 11 is, for example, 90% or more and 150% or less. The longitudinal elongation of the second fabric 12 is, for example, 180% or more and 280% or less. The transverse elongation of the second fabric 12 is, for example, 80% or more and 180% or less.

The glove 1 includes a base portion 2, a first finger portion 3A, a second finger portion 3B, a third finger portion 3C, and a belt portion 4.

The base portion 2 is tubular. Hereinafter, the openings at opposite ends of the axial direction of the base portion 2 are referred to as a proximal opening 21 and a distal opening 22, respectively. The proximal opening 21 corresponds to the entrance through which the user puts his or her hand into the glove 1. The end edge forming the distal opening 22 in the base portion 2 is continuous with the second finger portion 3B and the third finger portion 3C, as described later. In addition, a specific part being continuous with another part includes a case where the specific part is composed of fabric separate from that another part and the fabrics are sewn together, and a case where the specific part is composed of fabric that is integral with that another part. The same applies hereinafter.

Figure 3:
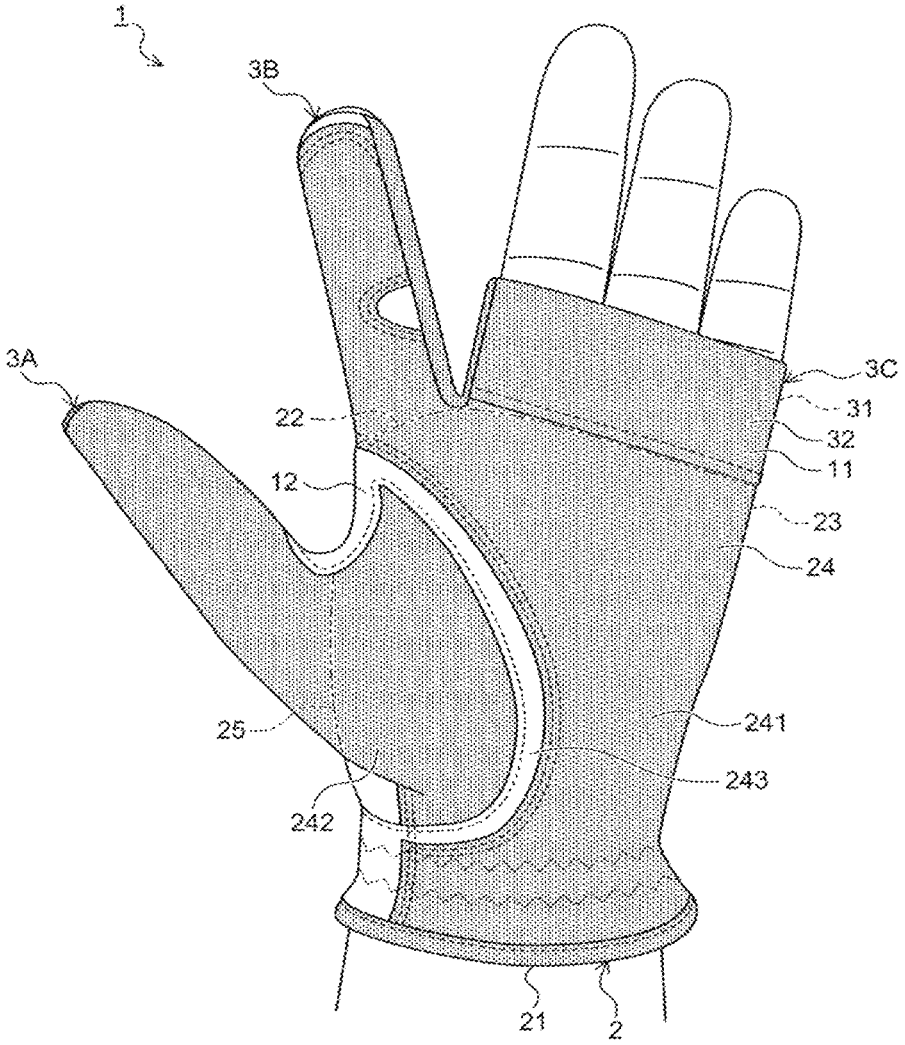
FIG. 3 is a rear view of a glove with a belt portion closed according to a first embodiment.

As shown in FIGS. 1 and 3, the base portion 2 includes a dorsal portion 23 and a palm portion 24. The dorsal portion 23 and the palm portion 24 face each other. Each of the dorsal portion 23 and the palm portion 24 has two end edges extending from the proximal opening 21 side toward the distal opening 22 side. The two corresponding end edges of the dorsal portion 23 and the palm portion 24 are continuous with each other, except for the part forming a lateral opening 25. The lateral opening 25 is an opening formed on the side of the base portion 2. As described later, the end edge forming the lateral opening 25 in each of the dorsal portion 23 and the palm portion 24 is continuous with the first finger portion 3A.

As shown in FIG. 1, the dorsal portion 23 is formed in a shape corresponding to the back of the user's hand. The dorsal portion 23 is configured to cover the back of the user's hand. To be specific, the dorsal portion 23 is configured to at least partially cover the back of the user's hand. The dorsal portion 23 has a dorsal main portion 231 and a joint portion 232.

The dorsal main portion 231 is roughly rectangular. The dorsal main portion 231 is configured to cover the area from the user's wrist to just before the base of each finger, from the thumb to the little finger. The dorsal main portion 231 is configured by overlapping the first fabric 11 over the second fabric 12. That is, the inner surface of the dorsal main portion 231 is composed of the second fabric 12 whereas the outer surface of the dorsal main portion 231 is composed of the first fabric 11. The inner surface of the dorsal main portion 231 refers to a surface forming the inner surface of the glove 1 among both surfaces of the dorsal main portion 231. The inner surface of the glove 1 can also be said to be the surface that comes into contact with the user's hand when the glove 1 is worn on the user's hand. The outer surface of the dorsal main portion 231 is the surface among the two sides of the dorsal main portion 231 that constitutes the outer surface of the glove 1.

The joint portion 232 is roughly L-shaped. The joint portion 232 is configured to cover the base of each finger from the user's thumb to the little finger. In other words, the joint portion 232 is configured to cover the third (metacarpophalangeal) joint of each finger from the user's thumb to the little finger. The joint portion 232 is adjacent to two consecutive sides of the dorsal main portion 231, which is roughly rectangular in shape. The joint portion 232 is made of the second fabric 12. The second fabric 12 forming the joint portion 232 may be continuous (i.e., integral) with the second fabric 12 forming the dorsal main portion 231, for example.

Figure 2:
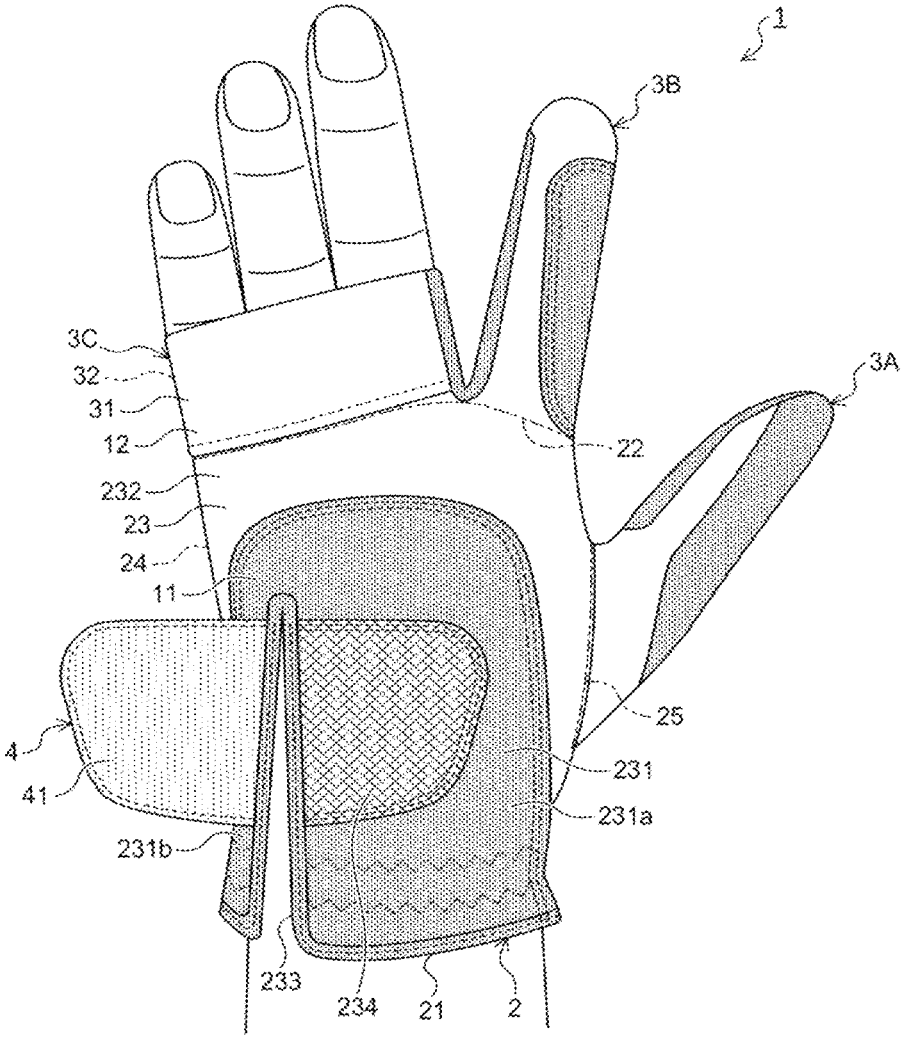
FIG. 2 is a front view of a glove with a belt portion open according to a first embodiment.

As shown in FIG. 2, a cut portion 233 is provided in the dorsal main portion 231. The cut portion 233 extends from the proximal opening 21 side toward the distal opening 22 side. The dorsal main portion 231 has a radial portion 231*a* and an ulnar portion 231*b*. The radial portion 231*a* is a part located closer to the first finger portion 3A than the cut portion 233. In other words, the radial portion 231*a* is a part that is located closer to the user's thumb side than the cut portion 233 when the glove 1 is worn on the user's hand. The ulnar portion 231*b* is a part located on the opposite (farther) side from the first finger portion 3A than the cut portion 233. In other words, the ulnar portion 231*b* is a part that is located closer to the user's little finger than the cut portion 233 when the glove 1 is worn on the user's hand.

An engaging portion 234 is installed on the outer surface of the radial portion 231*a*. The outer surface of the radial portion 231*a* is included in the outer surface of the dorsal main portion 231. The engaging portion 234 is configured to be detachably engaged with an engaged portion 41 of the belt portion 4, which will be described later. The engaging portion 234 is arranged adjacent to the cut portion 233.

As shown in FIG. 3, the palm portion 24 is formed in a shape corresponding to the user's palm. The palm portion 24 is configured to cover the user's palm. The palm portion 24 has a palm center portion 241, a thenar eminence portion 242, and a boundary portion 243.

The palm center portion 241 is roughly trapezoidal. The palm center portion 241 is configured to cover the user's wrist to the base of each finger from the tip of the index finger from the little finger. However, the palm center portion 241 is configured so as not to cover the user's thumb. The palm center portion 241 is made of the first fabric 11.

The thenar eminence portion 242 is roughly oval in shape. The thenar eminence portion 242 is configured to cover the user's thenar eminence. The thenar eminence portion 242 is made of the first fabric 11.

The boundary portion 243 is roughly arc-shaped. The boundary portion 243 extends along the user's palm lifeline when the glove 1 is worn on the user's hand. The palm center portion 241 is positioned on the outer circumference of the arc-shaped boundary portion 243, and the thenar eminence portion 242 is positioned on the inner circumference. The boundary portion 243 connects the palm center portion 241 and the thenar eminence portion 242. The boundary portion 243 is made of the second fabric 12.

The first finger portion 3A, the second finger portion 3B, and the third finger portion 3C are continuous from the base portion 2. To be specific, as shown in FIGS. 1 and 3, the first finger portion 3A is continuous from the tip edge forming the lateral opening 25 in each of the joint portion 232 and the thenar eminence portion 242. The inner space of the first finger portion 3A is connected to the inner space of the base portion 2 through the lateral opening 25.

The second finger portion 3B and the third finger portion 3C are continuous from the tip edge forming the distal opening 22 in each of the joint portion 232 and the palm center portion 241. The second finger portion 3B and the third finger portion 3C are arranged in this order from the first finger portion 3A side. The inner space of the second finger portion 3B and the inner space of the third finger portion 3C are connected to the inner space of the base portion 2 through the distal opening 22.

When the user puts the glove 1 on his or her hand, the user's thumb is inserted into the first finger portion 3A. That is, the first finger portion 3A is configured to allow the user's thumb to be inserted. In the present embodiment, the length of the first finger portion 3A exceeds the tip of the user's thumb. In addition, the tip of the first finger portion 3A, that is, the end opposite to the base portion 2, is occluded. In this case, the first finger portion 3A may be configured to cover the entire user's thumb.

When the user puts the glove 1 on his or her hand, the user's index finger is inserted into the second finger portion 3B. That is, the second finger portion 3B is configured to allow the user's index finger to be inserted. In the present embodiment, the length of the second finger portion 3B exceeds the tip of the index finger. In addition, the tip of the second finger portion 3B, that is, the end opposite to the base portion 2, is occluded. In this case, it can also be said that the second finger portion 3B is configured to cover the entire user's index finger.

When the user puts the glove 1 on his or her hand, the user's middle, ring, and little fingers are inserted together into the third finger portion 3C. That is, the third finger portion 3C is configured so that the user's middle, ring, and little fingers can be inserted together. The tip of the third finger portion 3C, that is, the end opposite to the base portion 2, is open. In other words, the tip of the third finger portion 3C is not occluded. The length of the third finger portion 3C is a length that exposes at least the fingertips of the user's middle, ring, and little fingers. In the present embodiment, the length of the third finger portion 3C is a length at least partially exposing the second (proximal interphalangeal) joints of the user's middle, ring, and little fingers. The length of the third finger portion 3C may be, for example, a length that completely exposes the second joints of the user's middle and ring fingers. More specifically, the length of the third portion 3C may be, for example, a length from the bases of the user's middle and ring fingers to just before the second joints. Alternatively, the length of the third finger portion 3C may be, for example, a length that partially exposes the second joint of the user's little finger, or a length that completely exposes the second joint of the user's little finger. More specifically, the length of the third portion 3C may be, for example, a length that partially covers the second joint of the user's little finger, or a length that covers up to the second joint of the user's little finger.

Figure 4:
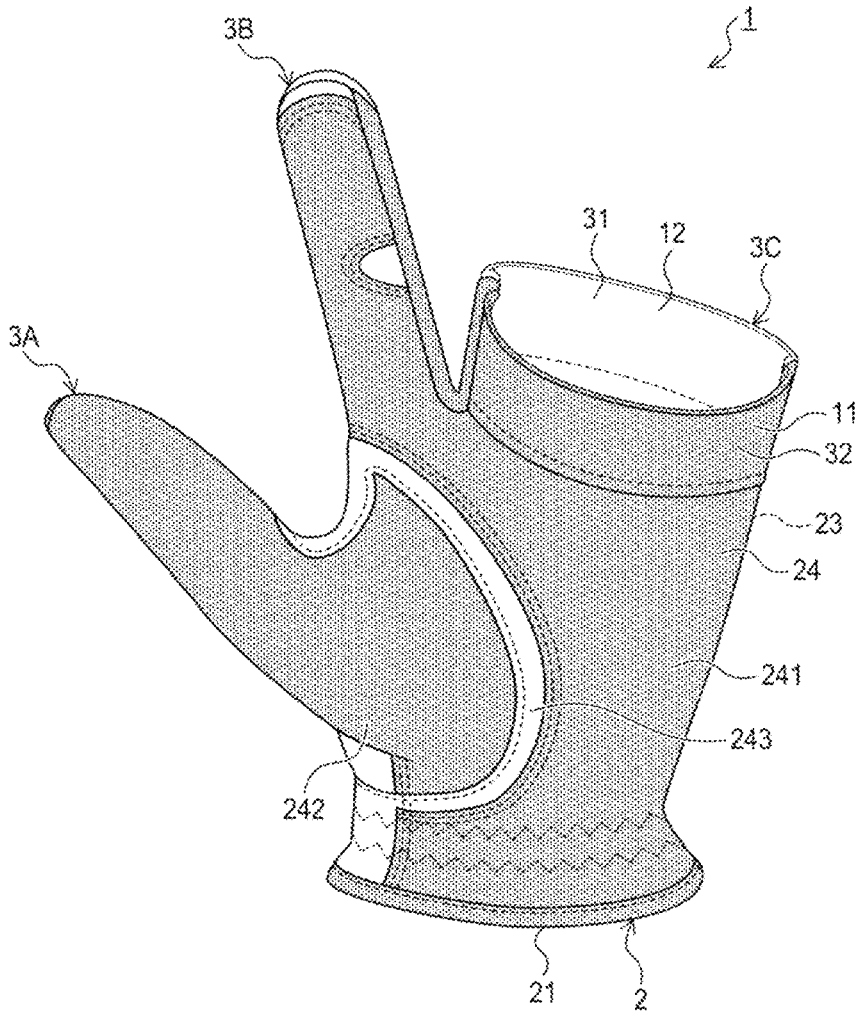
FIG. 4 is a view of a glove according to a first embodiment as viewed from the palm side and the fingertip side.

As shown in FIG. 4, the third portion 3C has an outer portion 31 and an inner portion 32. The outer portion 31 is a portion located on the dorsal portion 23 side in the circumferential direction of the third finger portion 3C. The inner portion 32 is a portion located on the palm portion 24 side in the circumferential direction of the third finger portion 3C. The outer portion 31 and the inner portion 32 are continuous in the circumferential direction of the third finger portion 3C. No partition is provided in the third finger portion 3C. The partition is a part that connects the outer portion 31 and the inner portion 32 and divides the interior of the third finger portion 3C.

The outer portion 31 is composed of the second fabric 12. The inner portion 32 is composed of the first fabric 11. It is preferable that the elongation of the inner portion 32 be smaller than that of the outer portion 31. The thickness of the third finger portion 3C is, for example, the same as or slightly lesser than the combined thickness of the user's middle, ring, and little fingers. In this case, when the user's middle, ring, and little fingers are inserted together, for example, by stretching the outer portion 31, both the outer portion 31 and the inner portion 32 come into close contact with these three fingers.

Referring back to FIG. 1, the belt portion 4 is plate-shaped. When viewed from the front, the belt portion 4 is roughly square. The belt portion 4 extends from the ulnar portion 231*b*. To be specific, the belt portion 4 extends from the end on the side of the cut portion 233 in the ulnar portion 231*b*.

As shown in FIGS. 1 and 2, the belt portion 4 is configured to be rotatable relative to the ulnar portion 231*b* by the user's operation, with the end edge that is continuous to the ulnar portion 231*b* as the rotation axis. As shown in FIG. 1, when the belt portion 4 is rotated in a direction approaching the radial portion 231*a*, the belt portion 4 faces the radial portion 231*a*. In another case, as shown in FIG. 2, when the belt portion 4 is rotated in a direction approaching the ulnar portion 231*b*, the belt portion 4 faces the ulnar portion 231*b*. Hereinafter, among the two sides of the belt portion 4, the side configured to be opposed to the ulnar portion 231*b* (i.e., the side shown in FIG. 1) is referred to as the outer surface, and the side configured to be opposed to the radial portion 231*a* (i.e., the side shown in FIG. 2) is referred to as the inner surface.

As shown in FIG. 2, the engaged portion 41 is installed on the inner surface of the belt portion 4. To be specific, the engaged portion 41 is installed over a substantially entire area of the inner surface of the belt portion 4. The engaged portion 41 is configured to be removably engaged with the aforementioned engaging portion 234. As an example, the engaging portion 234 and the engaged portion 41 are the hook surface and loop surface of Velcro.

1-2. Operation

When wearing the glove 1, the user first releases the engagement between the engaging portion 234 and the engaged portion 41, as shown in FIG. 2. Releasing the engagement between the engaging portion 234 and the engaged portion 41 may mean opening the belt portion 4.

Continuing, the user inserts his or her hand into the glove 1 from the proximal opening 21. As a result, the user's thumb is inserted into the first finger portion 3A, the index finger into the second finger portion 3B, and the middle, ring, and little fingers together are inserted into the third finger portion 3C. In addition, the back of the user's hand is covered by the dorsal portion 23, and the palm is covered by the palm portion 24.

Continuing, the user engages the engaging portion 234 and the engaged portion 41, as shown in FIG. 1. Engaging the engaging portion 234 and the engaged portion 41 may mean closing the belt portion 4. When engaging the engaging portion 234 and the engaged portion 41, the user may adjust the main length of the base portion 2 to fit his or her hand by adjusting the relative positions of the engaging portion 234 and the engaged portion 41.

Thereafter, the user holds the grip G of the golf club with the hand wearing the glove 1, as shown in FIGS. 5A and 5B. To be specific, the user places his or her hand on the grip G so that the grip G contacts the base of the hand wearing the glove 1 from the index finger to the little finger. Then, the user holds the grip G by bending the fingers from the index to the little fingers. The user holds the grip G by applying force to the three fingers, especially the middle, ring, and little fingers, among the four fingers from the index to the little fingers.

When the user puts the glove 1 on his or her hand and holds the grip G, the user's middle finger, ring finger, and little finger are inserted together into the third finger portion 3C. Since the third finger portion 3C has a length that exposes at least the fingertips of the user's middle finger, ring finger, and little finger, at least the bases of the user's middle finger, ring finger, and little finger are covered by the third finger portion 3C. The bases of the user's middle, ring, and little fingers are the parts that make the strongest contact with the grip G. Since these bases are covered by the third finger portion 3C, and the third finger portion 3C protects these bases, the user may easily hold the grip G with the middle, ring, and little fingers without slack.

In addition, since the user's middle, ring, and little fingers are inserted together into the third finger portion 3C, as the user bends the middle, ring, and little fingers to hold the grip G, the third finger portion 3C is curved toward the palm portion 24 side (i.e., the user's palm side). For example, when the user increases the force applied to the middle finger, the third finger portion 3C bends further and presses the ring finger and little finger from the dorsal portion 23 side (i.e., the back side of the user's hand). Thus, the ring finger and little finger become more prone to bending. According to the inventors' examination of the examples, the ring finger and little finger are the fingers that are relatively difficult to exert force among the five fingers. Since the ring finger and little finger are particularly more easily flexed by the third finger portion 3C, the user may easily hold the grip G without slack.

In addition, when the user wears the glove 1, compared to when the user is not wearing the glove 1, the user's hand is less likely to slip from the grip G when swinging a golf club due to friction between the glove 1, particularly the third finger portion 3C, and the grip G. Furthermore, with the glove 1, since it is easy for the user to hold the grip G without slack as described above, the user's hand is even less likely to slip from the grip G when swinging a golf club.

When the user puts the glove 1 on his or her hand and holds the grip G, the user's middle finger, ring finger, and little finger are inserted together into the third finger portion 3C, which also contributes to making it easier to sharpen the sensation of holding the grip G. One reason for this is that the user's middle finger, ring finger, and little finger are in direct contact with each other. For example, compared to respectively inserting the user's middle, ring, and little fingers into different tubular portions, the user may experience a sensation closer to that of a bare hand, as the adjacent fingers are in direct contact with each other. Consequently, the user's sense of the middle, ring, and little fingers tend to be sharpened.

In addition, at least the tips of the user's middle, ring, and little fingers are exposed from the third finger portion 3C. The fingertips are the most sensitive parts of the fingers, with the most sensory points. Thus, by exposing at least the tips of the user's middle, ring, and little fingers from the third finger portion 3C and making contact with the grip G, the sensation of the user's middle, ring, and little fingers may be made more sensitive.

As described above, according to the glove 1, it is possible to make it easy to enhance the feeling of holding the grip G and to make the user's hand less likely to slip from the grip G during a swing.

1-3. Effects

According to the first embodiment described above, the following effects are achieved.

(1a) In the glove 1, the third finger portion 3C is configured to allow the user's middle finger, ring finger, and little finger to be inserted together. The length of the third finger portion 3C is such that at least the fingertips of the user's middle, ring, and little fingers are exposed.

Due to the above configuration, when the user holds the grip G of the golf club with the hand equipped with the glove 1, at least the bases of each of the user's middle, ring and little fingers may be protected by the third finger portion 3C. In addition, the third finger portion 3C allows the user to more easily bend the ring and little fingers, which allows the user to hold the grip G without slack, making the user's hand less likely to slip from the grip G during a golf swing. As a result, swing stability and head speed may be significantly improved.

In addition, according to the above configuration, since the user's middle, ring, and little fingers can be in direct contact with each other, the sensation of these fingers may be more easily heightened. In particular, since the fingertips, which are the most sensitive parts of these fingers are at least exposed, the sensation of these fingers may be heightened even more easily. This makes it easier to sharpen the sensation of holding the grip G. As a result, it becomes possible to more delicately and easily control the grip G strength and the direction of the golf club head.

(1b) The third finger portion 3C has a length in which the first (distal interphalangeal) joints of each of the user's middle, ring, and little fingers are completely exposed, and also in which the second joints of these fingers are at least partially exposed. According to this configuration, when the user is wearing the glove 1 on his or her hand, the first joints of the user's middle, ring, and little fingers are completely exposed, and the second joints of these fingers are also at least partially exposed, so that the user may more easily bend the middle, ring and little fingers. In addition, when the user is wearing the glove 1 on his or her hand, the bases of the middle, ring, and little fingers, which are the parts that come into the strongest contact with the grip G, are covered by the third finger portion 3C. For this reason, the effect of protecting the bases of the middle, ring, and little fingers by the third finger portion 3C may be maintained. Thus, the user may easily hold the grip G without slack. Furthermore, the user's hand may be less likely to slip from the grip G when swinging.

In addition, According to the above configuration, for example, compared to a configuration in which the third finger portion 3C has only the length that exposes the tips of the user's middle, ring, and little fingers, the range of exposure of the middle, ring, and little fingers is wide when the user is wearing the glove 1. For this reason, when the user wears the glove 1 and holds the grip G, it is easier to obtain a feeling closer to that of a bare hand. Thus, it is easier to enhance the feeling of holding the grip G.

(1c) The third finger portion 3C has the outer portion 31 and the inner portion 32. The elongation of the inner portion 32 is, for example, smaller than that of the outer portion 31.

With this configuration, it is possible to make it more difficult for the inner portion 32 to elongate than the outer portion 31. Accordingly, it is possible to make it more difficult for the inner portion 32 to become loose. The inner portion 32 is the part that comes into contact with the grip G when the user holds the grip G with the hand wearing gloves 1, and thus allows the user to hold the grip G more easily and without slack.

Furthermore, the fact that the inner portion 32 may be made more difficult to elongate than the outer portion 31 means, in other words, that the outer portion 31 may be made more easily to elongate than the inner portion 32. For this reason, when the user holds the grip G with the hand equipped with the glove 1, the third finger portion 3C may be made more easily to be curved toward the palm portion 24 as the middle, ring, and little fingers are bent. Thus, the curved third finger portion 3C makes it easier for the user to bend the ring finger and little finger more easily. From this, it can be said that the user may hold the grip G more easily without slack.

Since the user may easily hold the grip G without slack, the user's hand may be less likely to slip from the grip G during a golf swinging.

2. Second Embodiment

2-1. Configuration

Since the second embodiment has the same basic configuration as the first embodiment, the differences will be described below. In addition, the same reference numerals as in the first embodiment indicate the same configuration, and reference is made to the preceding description.

Figure 6:
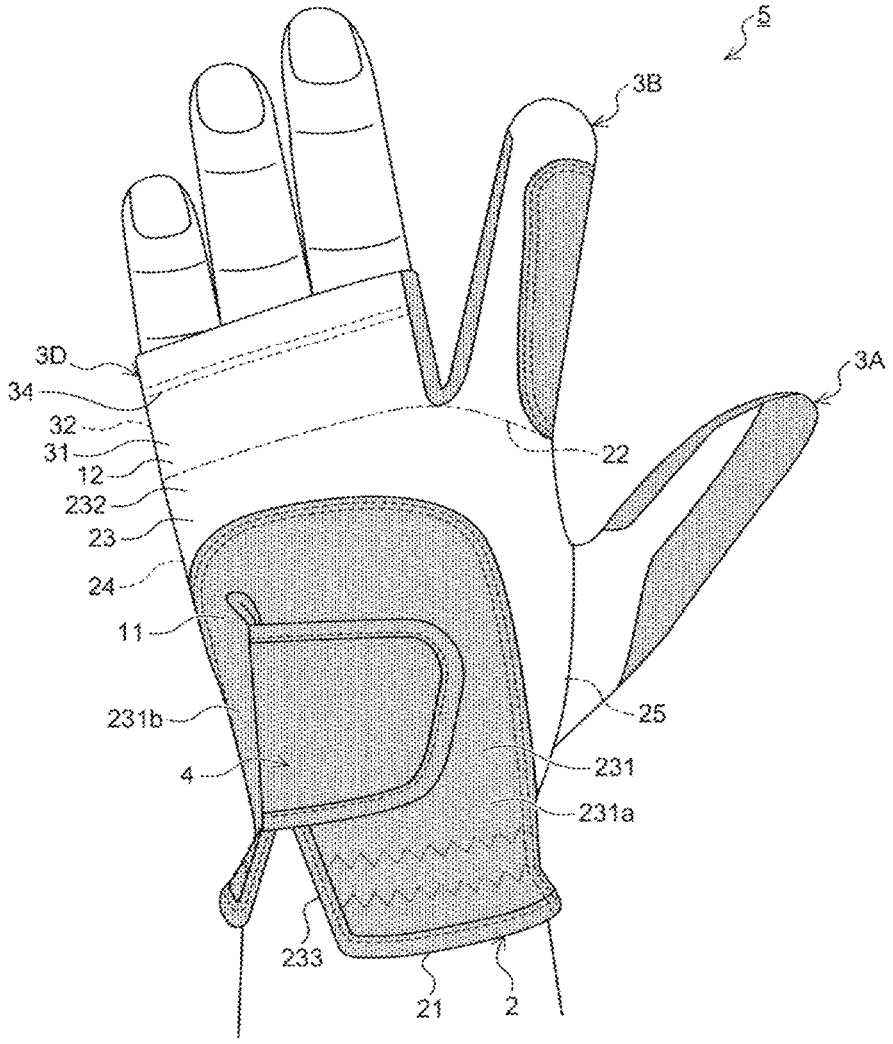
FIG. 6 is a front view of a glove with a belt portion closed according to a second embodiment.
Figure 7:
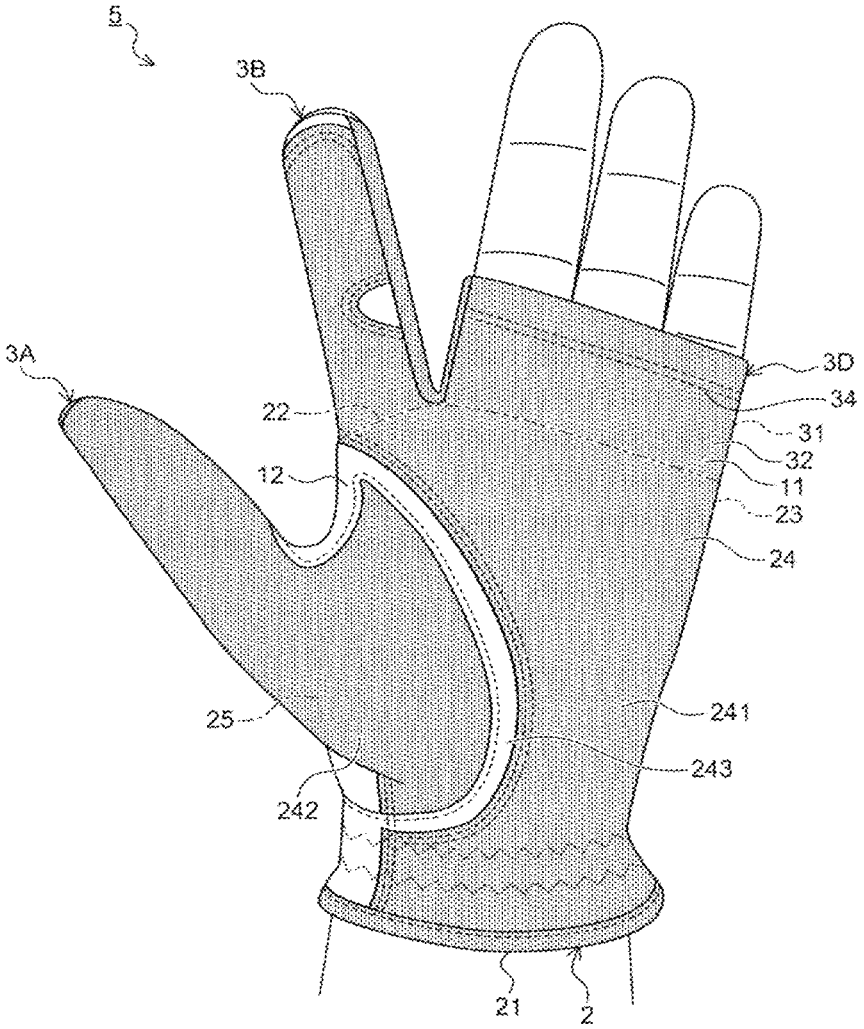
FIG. 7 is a rear view of a glove with a belt portion closed according to a second embodiment.
Figure 8:
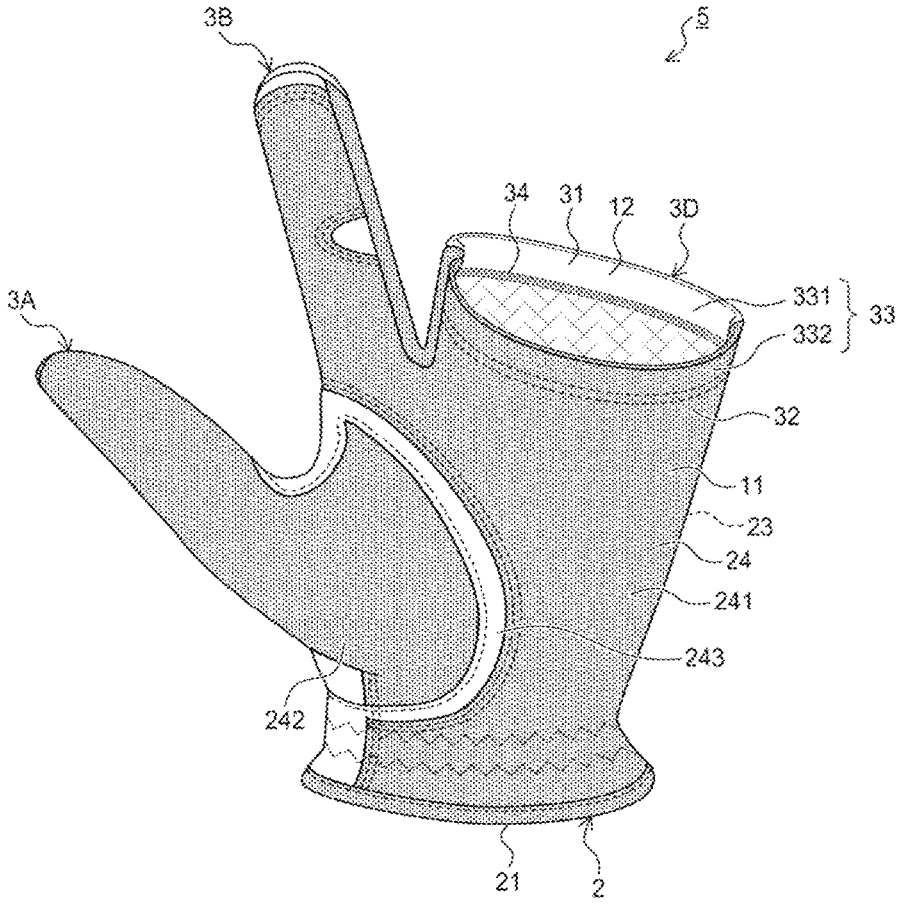
FIG. 8 is a view of a glove according to a second embodiment viewed from the palm side and the fingertip side.

A glove 5 of the second embodiment shown in FIGS. 6 and 7 is different from the glove 1 of the first embodiment in that the glove 5 has a third finger portion 3D instead of the third finger portion 3C described above. The third finger portion 3D has a configuration substantially similar to that of the third finger portion 3C described above. However, as shown in FIG. 8, the tip of the third finger portion 3D has a fold portion 33.

The fold portion 33 is a portion folded toward the inner circumference of the third finger portion 3D. The fold portion 33 of the present embodiment extends along the entire circumference of the third finger portion 3D. The fold portion 33 of the present embodiment includes a first portion 331 and a second portion 332. The first portion 331 is a part included in the outer portion 31. In other words, the first portion 331 is a part where the tip of the outer portion 31 is folded toward the inner circumference of the third finger portion 3D. The second portion 332 is a part included in the inner portion 32. In other words, the second portion 332 is a part where the tip of the inner portion 32 is folded toward the inner circumference of the third finger portion 3D.

The fold portion 33 includes a stitch 34 using stretch yarn. The elongation of the stretch yarn is, for example, 20% or more and 50% or less. The elongation of the stretch yarn is measured in accordance with method A described in JIS L 1013:2010 8.11. The elongation recovery rate of the stretch yarn is, for example, 60% or more and 100% or less. The elongation recovery rate of the stretch yarn is measured in accordance with JIS L 1013:2010 8.12.

The stitch 34 follows the edge of the tip side of the fold portion 33 (i.e., the tip side of the user's finger when the user is wearing the glove 5. The stitch 34 of the present embodiment extends around the entire circumference of the third finger portion 3D. That is, the stitch 34 of the present embodiment is inserted into both the first portion 331 and the second portion 332.

Since the stitch 34 is formed by the stretch yarn, the stitch 34 exhibits elasticity. In terms of further enhancing elasticity, it is preferable that the stitch 34 be at least one of a cover stitch, a zigzag stitch, and a knit stitch. In terms of further enhancing elasticity and durability, it is preferable that the stitch 34 is the cover stitch. The cover stitch includes a two-needle cover stitch, a three-needle cover stitch, a four-needle cover stitch, and a lock cover stitch. In terms of increasing durability without increasing the difficulty of sewing too much, the two-needle cover stitch is preferably used among these. A lower difficulty of sewing can lead to a reduction in the cost of forming the stitch 34 (i.e., the manufacturing cost of the glove 5).

Figure 9:
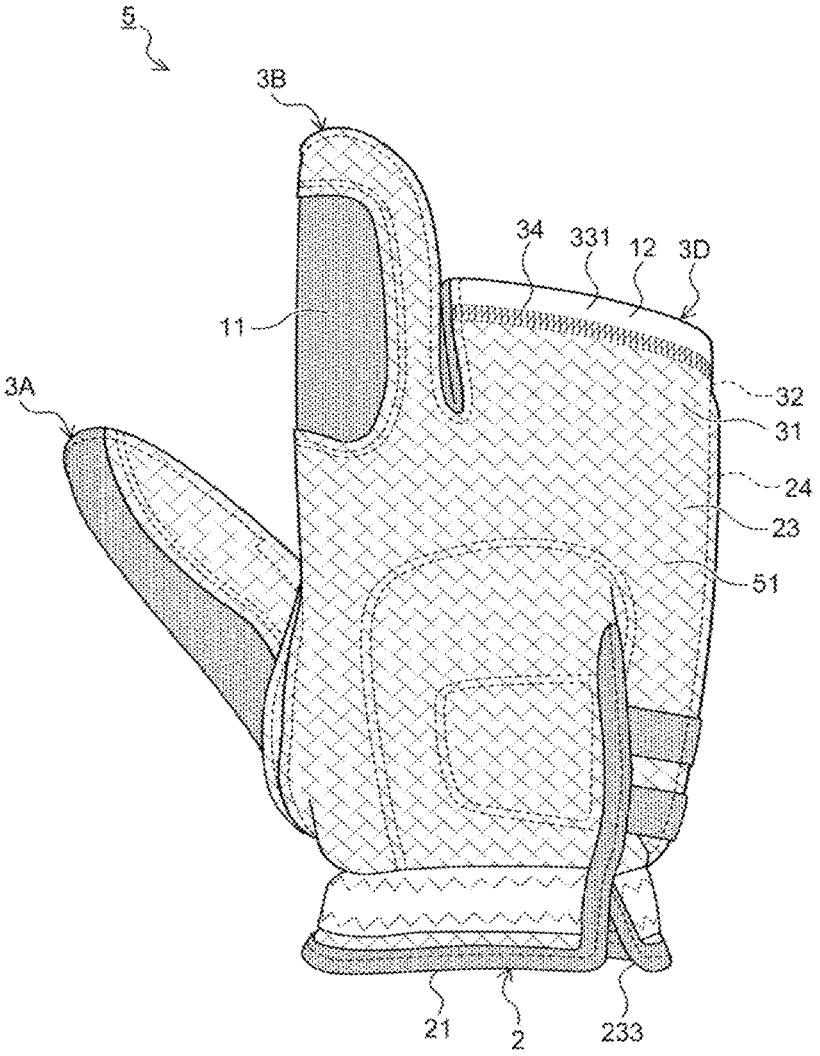
FIG. 9 is a view of a glove according to a second embodiment, turned over and viewed from a position facing the back of the hand.

As shown in FIG. 9, the glove 5 of the second embodiment further differs from the glove 1 of the first embodiment in that an anti-slip portion 51 is provided on the inner surface of the glove 5. The anti-slip portion 51 is a portion protruding from the inner surface of the glove 5. The anti-slip portion 51 is formed by so-called silicone printing. That is, the anti-slip portion 51 contains a silicone resin. The anti-slip portion 51 has a greater frictional force with the user's hand than the fabrics constituting the glove 5. Thus, by installing the anti-slip portion 51 on the inner surface of the glove 5, the position of the glove 5 with respect to the user's hand becomes less likely to be misaligned.

The anti-slip portion 51 may be installed, for example, only in a part of the inner surface of the glove 5, or may be installed in the entire inner surface of the glove 5. However, in order to make it more difficult for the glove 5 to be misaligned with respect to the user's hand, it is preferable that the anti-slip portion 51 be installed at least in the inner surface of the dorsal portion 23. In the present embodiment, the anti-slip portion is provided in the entire area of the inner surface of the dorsal portion 23, as well as in the area formed by the second fabric 12 in the first finger portion 3A, the second finger portion 3B, and the third finger portion 3D, and is also provided in the area other than the fold portion 33. Accordingly, in the third finger portion 3D, the anti-slip portion 51 is installed in all areas except the first portion 331 on the inner surface of the outer portion 31.

The shape of the anti-slip portion 51 is not particularly limited, but in terms of making it difficult to peel off the anti-slip portion 51 from the inner surface of the glove 5, it is preferable that the anti-slip portion 51 be formed of linear sections. The anti-slip portion 51 of the present embodiment has a shape in which a plurality of linear sections is arranged to intersect each other. That is, the anti-slip portion 51 of the present embodiment is formed in a mesh shape.

2-2. Effects

According to the second embodiment described above, in addition to the same effects as the first embodiment, the following effects are obtained.

(2a) The third finger portion 3D has the stitch 34 at least on the outer portion 31 among the outer portion 31 and the inner portion 32. Due to this configuration, when the user wears the glove 5, it is easy to make the third finger portion 3D fit more closely to the user's middle, ring, and little fingers. That is, it is easy to further enhance the fit of the third finger portion 3D. By further enhancing the fit of the third finger portion 3D, for example, the third finger portion 3D may be prevented from slipping down toward the base portion 2. Accordingly, the user may easily hold the grip G without slack while wearing the glove 5. Furthermore, it is possible to reduce the slippage of the user's hand from the grip G when swinging a golf club.

(2b) In the present embodiment, the stitch 34 is included on both the outer portion 31 and the inner portion 32. Due to this configuration, the effect of (2a) may be further enhanced.

(2c) In the glove 5, since the user's middle, ring, and little fingers are inserted together into the third finger portion 3D, the degree of freedom of these three fingers is likely to increase compared to, for example, a configuration in which the user's middle, ring, and little fingers are respectively inserted into different tubular portions. In particular, in the case that the length of the third finger portion 3D is such that the second joints of each of the user's middle, ring, and little fingers are at least partially exposed, as in the present embodiment, the degree of freedom of these three fingers is likely to be significantly increased compared to the case where the length of the third finger portion 3D is such that only the tips of each of the user's middle, ring, and little fingers are exposed.

When the user is wearing the glove 5, in case that the user's middle, ring, and little fingers have a high degree of freedom, the user may easily obtain a sensation similar to that of a bare hand. Moreover, since the user's middle, ring, and little fingers tend to have a large range of motion, there is a possibility that the glove 5 may be misaligned with respect to the user's hand, for example, when swinging a golf club.

For this reason, the glove 5 has the anti-slip portion 51 installed at least on the inner surface of the dorsal portion 23. Due to this configuration, the user may more easily obtain a sensation akin to that of a bare hand by means of the third finger portion 3D, while preventing the glove 5 from being misaligned with respect to the user's hand. Since the user can more easily obtain a sensation akin to that of a bare hand, it is easy to make the feeling of holding the grip G more sensitive as in (1a) and (1b) above. By preventing the misalignment of the position of the glove 5 relative to the user's hand, the user may easily hold the grip G without slack while wearing the glove 5. Furthermore, it is possible to reduce the slippage of the user's hand from the grip G when swinging a golf club.

(2d) In the present embodiment, the anti-slip portion 51 is also installed on the inner surface of the outer portion 31. Due to this configuration, the effect of (2c) may be further enhanced.

(2e) The anti-slip portion 51 is provided in the form of a mesh. Due to this configuration, for example, even when the user repeatedly uses the glove 5 over a long period of time, the anti-slip portion 51 may be prevented from peeling off from the inner surface of the glove 5.

3. Another Embodiment

Above, the embodiments of the present disclosure have been described, but the present disclosure is not limited to the above embodiments and may take various forms.

(3a) In the first and second embodiments described above, the glove 1 or 5 is formed by, for example, cutting and sewing a plurality of fabrics. In this case, the arrangement of each fabric in the gloves is not particularly limited. However, as exemplified in the above embodiments, in the third finger portion 3C or 3D, it is preferable that the elongation of the inner portion 32 be smaller than the elongation of the outer portion 31. This is because the effect of (1c) may be obtained.

(3b) In the second embodiment, the third finger portion 3D has the fold portion 33, and the stitch 34 is included in the fold portion 33. However, when a stitch is included in the third finger portion, the third finger portion does not necessarily have to have a fold portion. For example, a stitch may be included in the third finger portion that does not have a fold portion.

(3c) In the above first and second embodiments, as specific examples of the engaging portion 234 and the engaged portion 41, the hook surface and the loop surface of Velcro were mentioned. However, the engaging portion and the engaged portion do not necessarily have to be Velcro. For example, one side of the engaging portion and the engaged portion may be a concave portion, and the other side may be a convex portion that can be inserted into the concave portion.

(3d) FIGS. 1 to 9 referred to for the description of the first and second embodiments above illustrate the glove 1 or 5 to be worn on the user's left hand. However, the glove may be configured to be worn on the user's left hand, or may be configured to be worn on the user's right hand, for example.

(3e) In the above embodiments, the glove 1 or 5 is for golf. However, the use of the gloves is not particularly limited. For example, the gloves may be for batting or fishing. That is, the gloves may be used to hold a stick-shaped part other than the grip G of a golf club, such as the grip of a baseball bat or a fishing rod, for example. In these cases, the stick-shaped part may be easily held without slack.

(3f) In the above embodiments, the function of one component may be distributed to multiple components, or the functions of multiple components may be integrated into one component. In addition, a part of the configuration of the above embodiment may be omitted. In addition, at least a part of the configuration of the above embodiment may be added, substituted, etc., to the configuration of another embodiment.

Technical Idea Disclosed in This Specification

Item 1

A golf glove that is worn on a hand of a user, the glove including:

a base portion including a dorsal portion which is a part configured to cover the back of the user's hand, and a palm portion which is a part opposite to the dorsal portion, configured to cover a palm of the user;

a first finger portion which is a part configured to allow a thumb of the user to be inserted in a tubular portion that continues from the base portion;

a second finger portion which is a part configured to allow an index finger of the user to be inserted in a tubular portion that continues from the base portion; and a third finger portion which is a part configured to allow middle, ring, and little fingers of the user to be inserted together in a tubular portion that continues from the base portion, wherein the length of the third finger portion is a length that exposes at least the fingertips of the middle, ring, and little fingers.

Item 2

The golf glove described in Item 1, wherein the length of the third finger portion is a length that at least partially exposes second joints of the middle, ring, and little fingers.

Item 3

The golf glove described in Item 1 or 2, wherein the third finger portion includes:

an outer portion located on the dorsal portion in the circumferential direction of the third finger portion; and an inner portion located on the palm portion in the circumferential direction of the third finger portion, wherein the elongation rate of the inner portion is smaller than that of the outer portion.

Item 4

The golf glove described in any one of Items 1 to 3, wherein the third finger portion includes:

an outer portion located on the dorsal portion in the circumferential direction of the third finger portion; and an inner portion located on the palm portion in the circumferential direction of the third finger portion, wherein of the outer and inner portions, at least the outer portion has a stitch made of stretch yarn across the edge opposite to the base portion.

Item 5

The golf glove described in Item 4, wherein the stitch is at least one of a cover stitch, a zigzag stitch, and a knit stitch.

Item 6

The golf glove described in any one of Items 1 to 5, wherein the dorsal portion includes an anti-slip portion protruding from the surface that contacts the back of the user's hand, wherein the anti-slip portion contains a silicone resin.

Item 7

The golf glove described in any one of Items 1 to 6, wherein the anti-slip portion is formed in a mesh shape.

What is claimed is:

1. A golf glove for wear on a hand of a user, the glove comprising:

a base portion comprising a dorsal portion which is a glove part configured to cover a back of the user's hand, and a palm portion which is a glove part opposite to the dorsal portion, configured to cover a palm of the user;

a first finger portion which is a glove part configured to allow a thumb of the user to be inserted in a tubular portion that continues from the base portion;

a second finger portion which is a glove part configured to allow an index finger of the user to be inserted in a tubular portion that continues from the base portion; and a third finger portion which is a glove part configured to allow fingers of the user other than the thumb and the index finger to be inserted together in a tubular portion that continues from the base portion, wherein the third finger portion is configured to cover bases of the fingers of the user other than the thumb and the index finger and has a length such that second joints of the fingers are at least partially uncovered.

2. The glove of claim 1, wherein the third finger portion comprises:

an outer portion located on the dorsal portion in a circumferential direction of the third finger portion; and an inner portion located on the palm portion in the circumferential direction of the third finger portion, wherein an elongation percentage of the inner portion is less than that of the outer portion.

3. The glove of claim 1, wherein the third finger portion comprises:

an outer portion located on the dorsal portion in a circumferential direction of the third finger portion; and an inner portion located on the palm portion in the circumferential direction of the third finger portion, wherein of the outer and inner portions, at least the outer portion has a stitch made of stretch yarn across an edge opposite to the base portion.

4. The glove of claim 3, wherein the stitch is at least one of a cover stitch, a zigzag stitch, and a knit stitch.

5. The glove of claim 1, wherein the dorsal portion comprises an anti-slip portion protruding from a surface that is configured to contacts the back of the user's hand, wherein the anti-slip portion contains a silicone resin.

6. The glove of claim 5, wherein the anti-slip portion is formed in a mesh shape.

* * * * *